US005348161A

United States Patent [19]

Mueller

[11] Patent Number: 5,348,161

[45] Date of Patent: Sep. 20, 1994

[54] PROCESS FOR GUIDING AIR FOR CLEANING SEMOLINA, AS WELL AS SEMOLINA CLEANING APPARATUS

[75] Inventor: Roman Mueller, Niedeuzwil, Switzerland

[73] Assignee: Buehler AG, Uzwil, Switzerland

[21] Appl. No.: 960,426

[22] PCT Filed: Apr. 4, 1992

[86] PCT No.: PCT/CH92/00071

§ 371 Date: Dec. 11, 1992

§ 102(e) Date: Dec. 11, 1992

[87] PCT Pub. No.: WO92/18257

PCT Pub. Date: Oct. 29, 1992

[30] Foreign Application Priority Data

Apr. 15, 1991 [CH] Switzerland ..... 0123/91

[51] Int. Cl.[5] ..... B07B 9/00

[52] U.S. Cl. ..... 209/29; 209/318; 209/321; 209/139.1

[58] Field of Search ..... 209/21, 30, 31, 36, 209/37, 22, 23, 28, 29, 138, 139.1, 317, 315, 318, 321, 312

[56] References Cited

U.S. PATENT DOCUMENTS

| | | | |
|---|---|---|---|
| 3,608,716 | 9/1971 | Rowell et al. | 209/154 X |
| 4,211,641 | 7/1980 | Jäger | 209/154 X |
| 4,213,852 | 7/1980 | Etkin | 209/154 X |
| 4,248,699 | 2/1981 | Hukki | 209/154 X |
| 4,266,673 | 5/1981 | Haidlen et al. | 209/154 X |
| 4,353,730 | 10/1982 | Kinno et al. | 209/139.1 |
| 4,634,522 | 1/1987 | Edholm et al. | 209/154 |
| 4,652,362 | 3/1987 | Mueller | 209/318 X |
| 4,680,107 | 7/1987 | Manola | 209/154 X |
| 4,701,256 | 10/1987 | Cross, Jr. | 209/154 X |
| 4,756,428 | 7/1988 | Jäeger | 209/154 X |
| 4,801,374 | 1/1989 | Harold | 209/135 |
| 4,806,235 | 2/1989 | Mueller | 209/154 X |

FOREIGN PATENT DOCUMENTS

| | | |
|---|---|---|
| 0155537 | 9/1985 | European Pat. Off. . |
| 0334180 | 9/1989 | European Pat. Off. . |
| 2176426 | 12/1986 | United Kingdom . |

*Primary Examiner*—D. Glenn Dayoan
*Attorney, Agent, or Firm*—McAulay Fisher Nissen Goldberg & Kiel

[57] ABSTRACT

A semolina cleaning apparatus allows basic operations as in the prior art with complete visual surveillance of operation, but with an outwardly closed product guidance. In this way, entry and exit of dust is completely prevented during normal operation as well as when removing samples. Accordingly, it is possible to operate an individual apparatus as well as an entire group of semolina cleaning apparatuses with circulating air. The air intake can be effected from above.

15 Claims, 6 Drawing Sheets

PROCESS FOR GUIDING AIR FOR CLEANING SEMOLINA, AS WELL AS SEMOLINA CLEANING APPARATUS

BACKGROUND OF THE INVENTION a) Field of the Invention

The invention is directed to a process for guiding air for cleaning semolina and to a semolina cleaning apparatus, wherein the product is cleaned via a plurality of swivelably supported sieve layers forming a cleaning section and via product discharges for the sieve tailings and is divided into the desired fractions below the sieve layers with a plurality of adjustable outlet sleeves for guiding the sieve throughs or siftings into two or more collecting troughs.

b) Background Art

Along with the roller mill and plan sifter, the semolina cleaning apparatus has developed into an apparatus of principal importance having the characteristic features of milling process technology. These characteristic features are:

an open process flow allowing the product to be viewed in the respective processing stages;

the possibility of removing product samples within critical operating stages for sensory evaluation or analytical testing;

the possibility for the miller to make corrections with respect to the adjustment of the apparatus and the product flow.

The principle of the fluid bed on one hand and classical sifting on the other are combined with a shaking movement of the sieve in the semolina cleaning apparatus.

The conventional sifting process works without air being guided through the sieve if possible. On the other hand, a fluid bed is produced with an intensive air flow in such a way that the product takes on a fluid, flowing state. The fluid bed follows very specific laws, separation by large and small parts being only the most well-known effect. The principal object of the semolina cleaning apparatus is to obtain semolina and middlings, varying granulation, and to sort out all husk parts which have a darker, often brownish color. Further, flour products with different qualitative characteristics can be sorted with the semolina cleaning apparatus.

A semolina cleaning apparatus with a completely closed system is known from the German Patent No. 29 181 from 1884. A twin ventilator sucks the air out of the upper part of the apparatus outfitted with a filter-cloth cleaning device and guides it back along the product collecting space to the lower side of the sieve. In contrast to more recent art the possibility for monitoring the operation of the semolina cleaning apparatus is very unsatisfactory, which would no longer be feasible particularly in cleaning sections having a plurality of sieve layers.

A peculiarity of mill grinding in the sense of modern high-technology milling is that, aside from the need to achieve a determined granulation, several substantial points must be taken into consideration particularly with respect to the material to be ground:

the starch granule for semolina products destined for the pasta industry must not be mechanically damaged since the pasta quality will otherwise suffer.

the gluten must not be damaged, e.g. by local heat, in the case of baking flour the large surface area of the outer husk parts must be kept as complete as possible and separated out.

The large surface area of the husk parts, in contrast to the more cubic shape of the flour and semolina parts, made use of in the semolina cleaning apparatus for sorting them out. This is effected based on the physical forces which force the flat parts to the top in an agitated fluid bed so that the latter can be separated out as sieve tailings. Only the flour and semolina parts, depending on size, are sifted in the semolina cleaning apparatus. This process is analogous to a calibration with the aim of a determined spectrum of grain sizes.

All demands with respect to the optimal functioning of the semolina cleaning apparatus are met by the quite unique concept as developed from its origins 100 years ago. The semolina cleaning apparatus has also become a specialized machine which is used almost exclusively in the area of grain milling. Any essential change in the concept would have to result in a change in function. Consequently, recent refinements, such as closing off the entire product flow from the outside for reasons of hygiene, cannot be solved in a reasonable manner without simultaneously challenging the basic requirement for openness and accessibility of the process.

OBJECT AND SUMMARY OF THE INVENTION

The primary object of the present invention is to improve the cleaning of semolina with respect to ventilation and hygiene while nevertheless maintaining all essential advantages of the latest concepts relating to openness.

The process according to the invention is characterized in that the exhaust air from at least two cleaning sections is collected in an air discharge line, sucked off via a separately arranged aspirator, cleaned and guided back as feed air via a feed duct below the sieve layers.

Surprisingly, it has been possible to improve the main operating means, namely the air or ventilation side, in that a common air system is associated with a plurality of cleaning sections rather than an independent air system being associated with every cleaning section.

The novel invention is further directed to a semolina cleaning apparatus having a plurality of swivelably supported sieve layers, air feed and air discharge, a product feed, a product discharge for the sieve tailings, and a product collecting base under the sieve layers with a plurality of adjustable outlet sleeves for conveying the sieve siftings into two or more collecting troughs, and is characterized in that the product collecting base, with an air feed duct extending long its length, forms an outwardly closed siftings space and, together with the sieve layers, a swivel unit. Self-cleaning is effected particularly in that the air feed duct is part of the swivel unit.

When a plurality of semolina cleaning sections or apparatuses are operating simultaneously the air feed duct can be connected directly to the air feed duct as an air return duct of a circulating air system or, in the case of an individual apparatus without circulating air, the fresh air can be sucked in via an air grate in the region of the upper part of the apparatus, preferably at an end part of the semolina cleaning apparatus, i.e. no longer from the base region as was previously the case.

However, the invention allows for a number of particularly advantageous additional constructions. For example, the outlet sleeves for the product are preferably arranged at the collecting base and have chokes. The collecting troughs are constructed as swivel troughs, the chokes preferably being constructed so as to be variable in cross section. Along with the collecting base and the collecting troughs, each sieve layer can have its own separate swivel drive. The collecting troughs are also preferably constructed as closed ducts and have transparent flaps on the upper side in the longitudinal direction for removing product samples.

It is further suggested that the air feed duct be arranged along the length of the sieve layers and approximately in the central region of the sieve layer. In this way, the entire region above the sieves remains free for windows for visual monitoring of the fluid bed.

Another particularly advantageous construction consists in the arrangement of a plurality of air quantity adjustment flaps between the air feed duct and the siftings space.

Accordingly, it is possible for the first time to do away with air quantity adjustment flaps in the dust space and to arrange them in the clean air part.

This contributes substantially to maintaining cleanliness in the interior of the semolina cleaning apparatus. The air inlet for the air feed duct can be arranged at one end side of the semolina cleaning apparatus and the feed duct can be arranged at approximately the same height as the sieve layer. The adjusting flaps are on the pressure side of the system.

It is further suggested to reconnect the air discharge with the air feed duct via a separator and a ventilator. This makes it possible for the first time to operate the semolina cleaning apparatus as a closed system and with circulating air. This is not only a substantial contribution to hygiene in the mill, but moreover a previously almost inevitable source of dust in milling process technology is completely eliminated in this way. Placing the swivel troughs under slight vacuum also eliminates interference in operation and discharge of dust when taking samples. In this way, a plurality of semolina cleaning apparatuses can be advantageously connected to a common air discharge line. However, a plurality of semolina cleaning apparatuses are preferably connected to a common air return line in circulating air operation. This enables a plurality of semolina cleaning apparatuses to be connected to a common dust separator unit and operated with circulating air.

In order to bring the entire ventilation system under control it is further suggested that the entire circulating air system be provided with an exhaust air line so that at least the upper region of the semolina cleaning apparatus can be placed under a vacuum relative to its surroundings.

For a better understanding of the present invention, reference is made to the following description and accompanying drawings while the scope of the invention will be pointed out in the appended claims.

DESCRIPTION OF THE PREFERRED EMBODIMENTS

Figure 1:
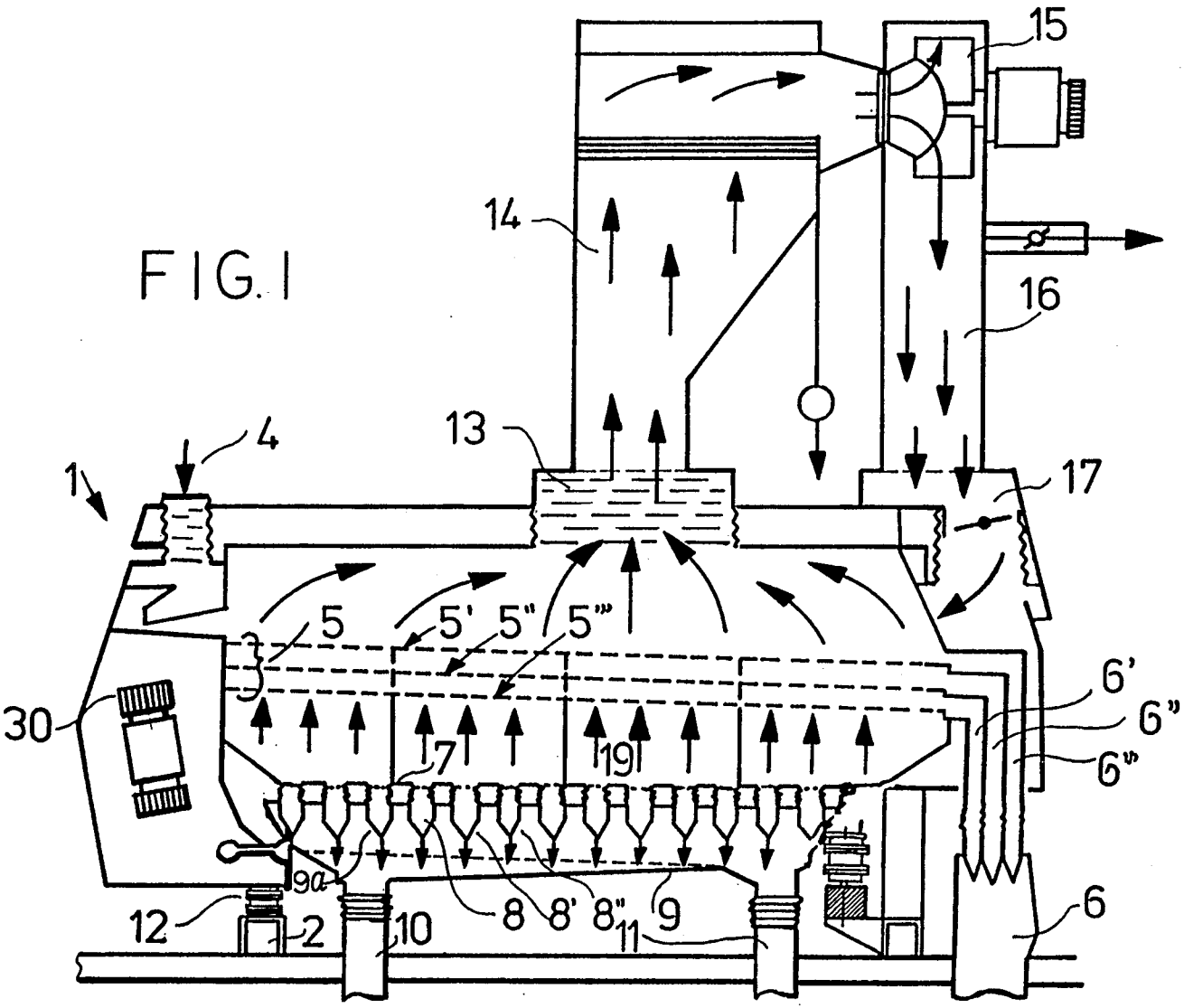
FIG. 1 shows a longitudinal section through a semolina cleaning apparatus.
Figure 6:
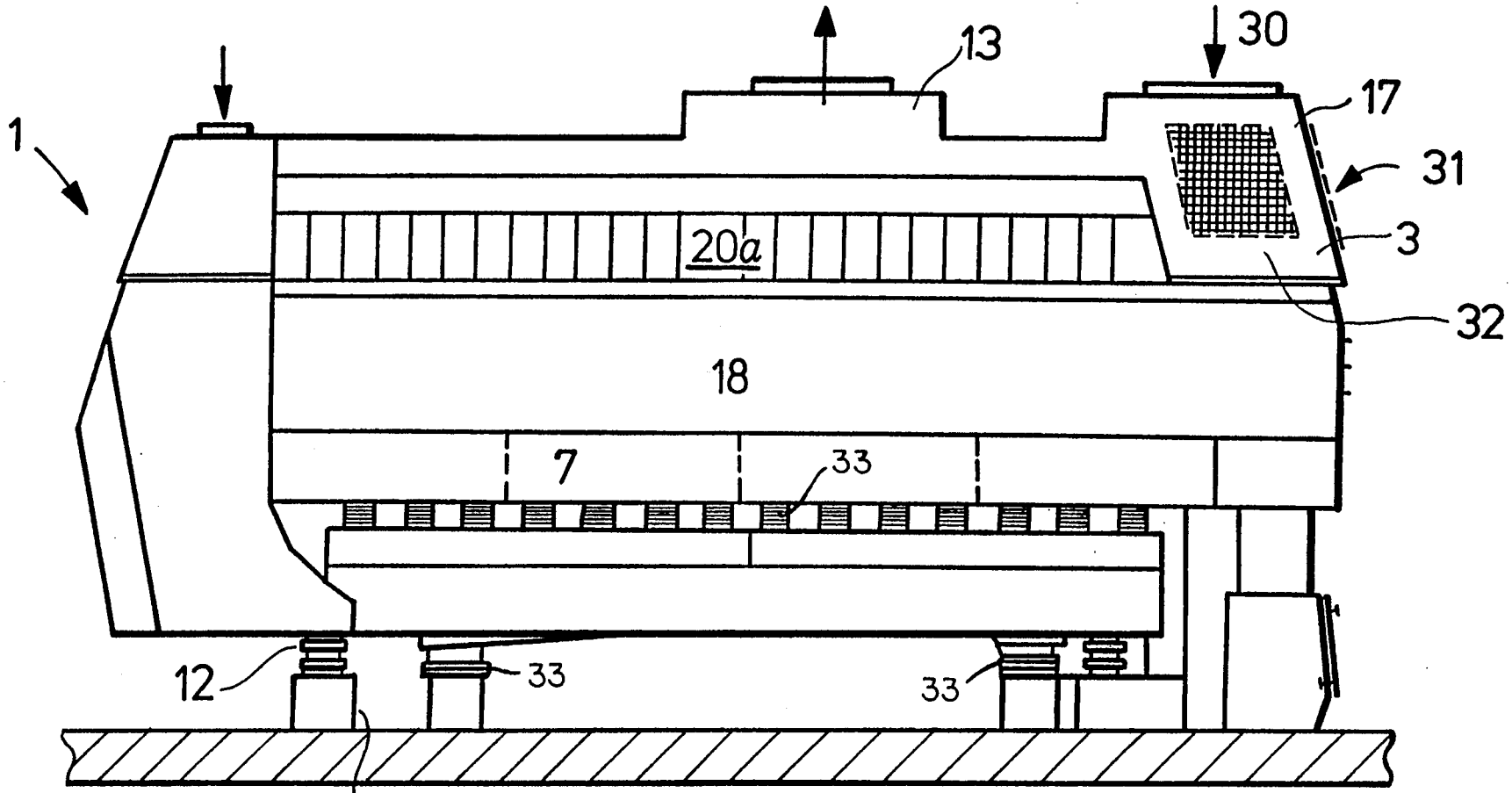
FIG. 6 shows a longitudinal view of the semolina cleaning apparatus.

FIGS. 1 and 6 are referred to in the following.

A semolina cleaning apparatus 1 is supported on a console 2 and has a stationary head part 3. The material is fed in via a product inlet 4 and an inlet cascade and guided directly to the uppermost sieve layer 5' of the sieves 5. The sieves 5 are jointly set in vibration by a vibration generator 30.

Figure 2:
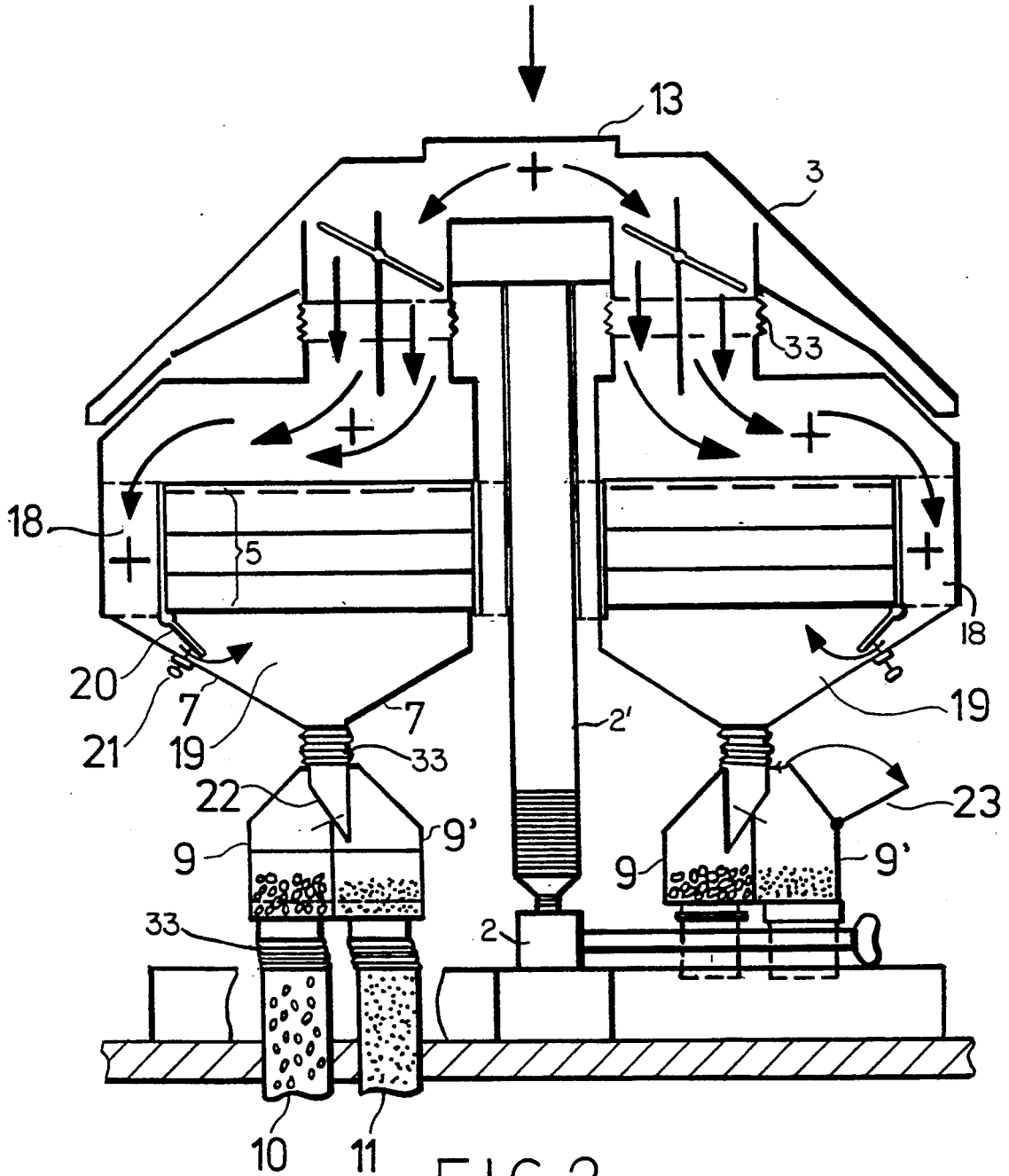
FIG. 2 shows the intake suction side with a cross section II—II of FIG. 1.

The material reaching the low end as tailings via the sieve layers 5', 5'', 5''' is discharged via product discharge ducts 6', 6'', 6''' and via a common product discharge duct 6 (FIG. 1). The sieve siftings arrive on a product collecting base 7 and via a plurality of transfer ducts 8, 8', 8'' etc. and are conveyed via respective chokes **9*a* into one of two collecting troughs 9 or 9', respectively, from which the material is conveyed along a discharge tube, either 10 or 11 depending on the product quality. All vibrating parts are supported on a spring element 12. An air discharge sleeve 13 is arranged in the upper central part of the semolina cleaning apparatus. The dust-laden air travels from the air discharge sleeve 13 via a dust separator 14, a ventilator 15 and an air return line 16 into a product siftings space 19 via a valve box 17 as a purified fresh air flow via an air feed duct 18 (FIG. 2). It is important that the fluid bed on the uppermost sieve layer 5 can be monitored visually via a window 20*a* as in prior art. In FIG. 2 (as well as in the following FIGS. 3–5) the semolina cleaning apparatus is shown as two identical apparatuses or as a double apparatus as is conventional for semolina cleaning apparatuses. However, it is substantial that the air feed duct 18 is duplicated for a desired control or air flow for each half of the apparatus. However, in the case of circulating air, the air feed and air discharge are combined. The passage from the air feed duct 18 into the siftings space 19 is effected through air regulating slides 20 via hand wheels 21. The two collecting troughs 9 and 9', respectively, contain different products, which is indicated by small circles and dots. The stationary head part 3 is held at a center support 2'. Each cleaning section with sieve layers 5, product collecting base 7 and air feed duct 18 forms a swivel unit which can be connected as a double unit and is connected to the stationary apparatus parts via flexible sleeves 33**.

The product flow from each individual transfer duct 8, 8', 8'' can be directed either into the collecting trough 9 or into the collecting trough 9' via an adjusting flap 22. This can be effected by swiveling to the right on the apparatus on the left or to the left on the apparatus on the right. A product sample can be removed from the respective transfer duct by opening flaps 23.

Figure 3:
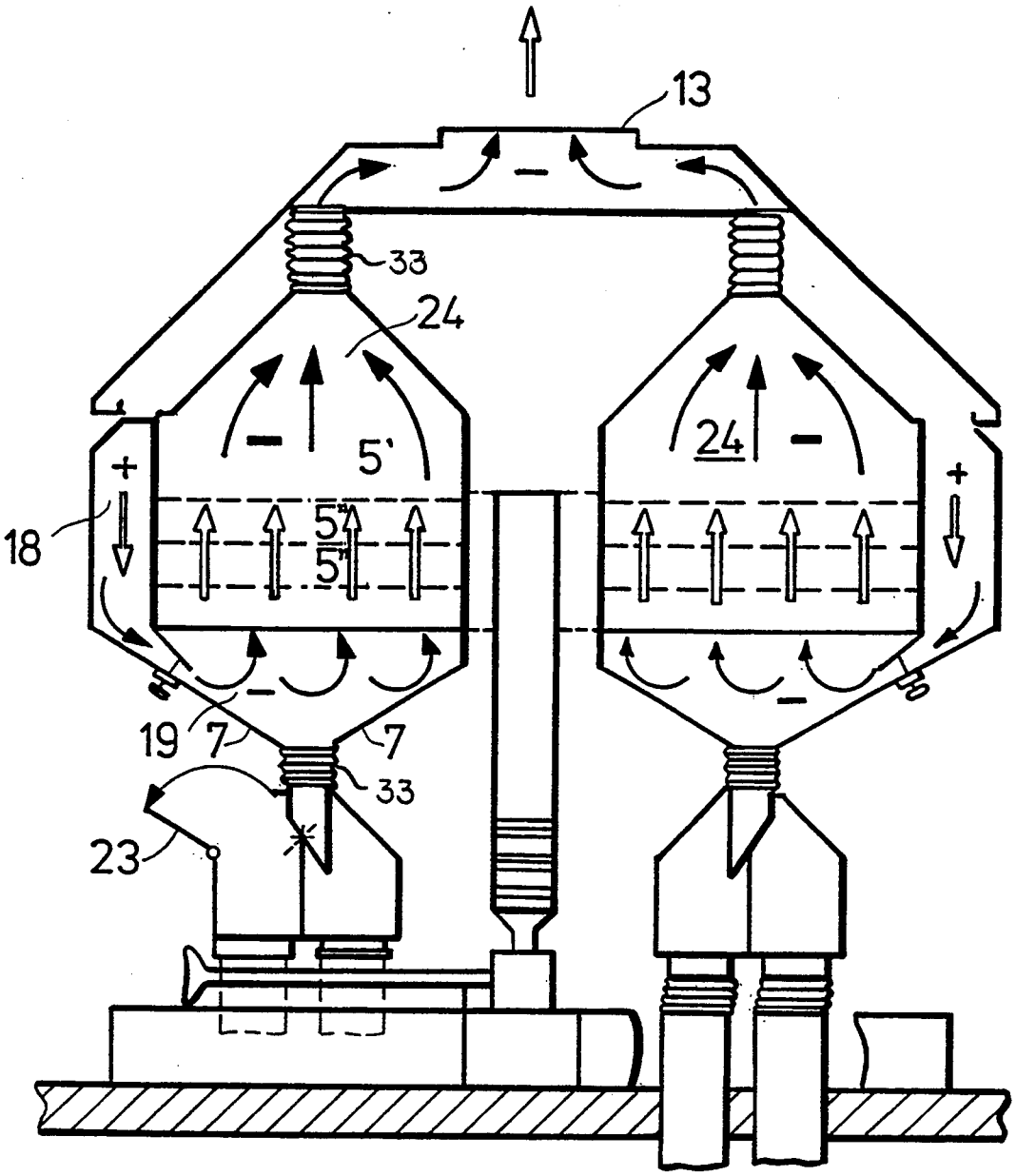
FIG. 3 shows the outlet suction side with a cross section III—III of FIG. 1.

FIG. 3 shows the air flow from the siftings space 19 through the sieve layers 5', 5'', 5''' and an air exhaust space 24.

Figure 4:
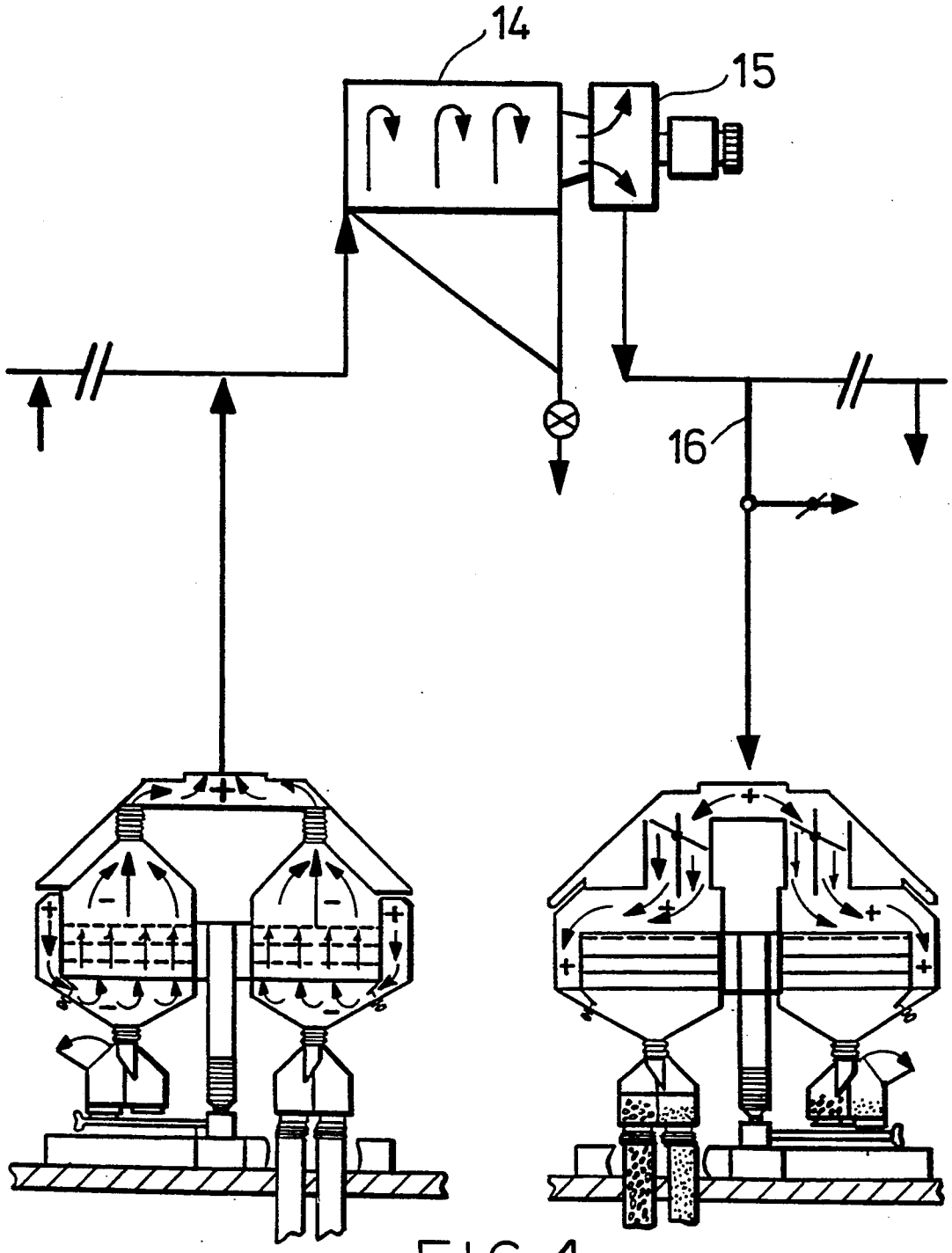
FIG. 4 is a schematic view of the intake side and suction side in connection with recirculated air.

FIG. 4 combines FIGS. 2 and 3, i.e. shows two different sections, the air discharge of a semolina cleaning apparatus on the left and the air feed of a semolina cleaning apparatus on the right.

Figure 5:
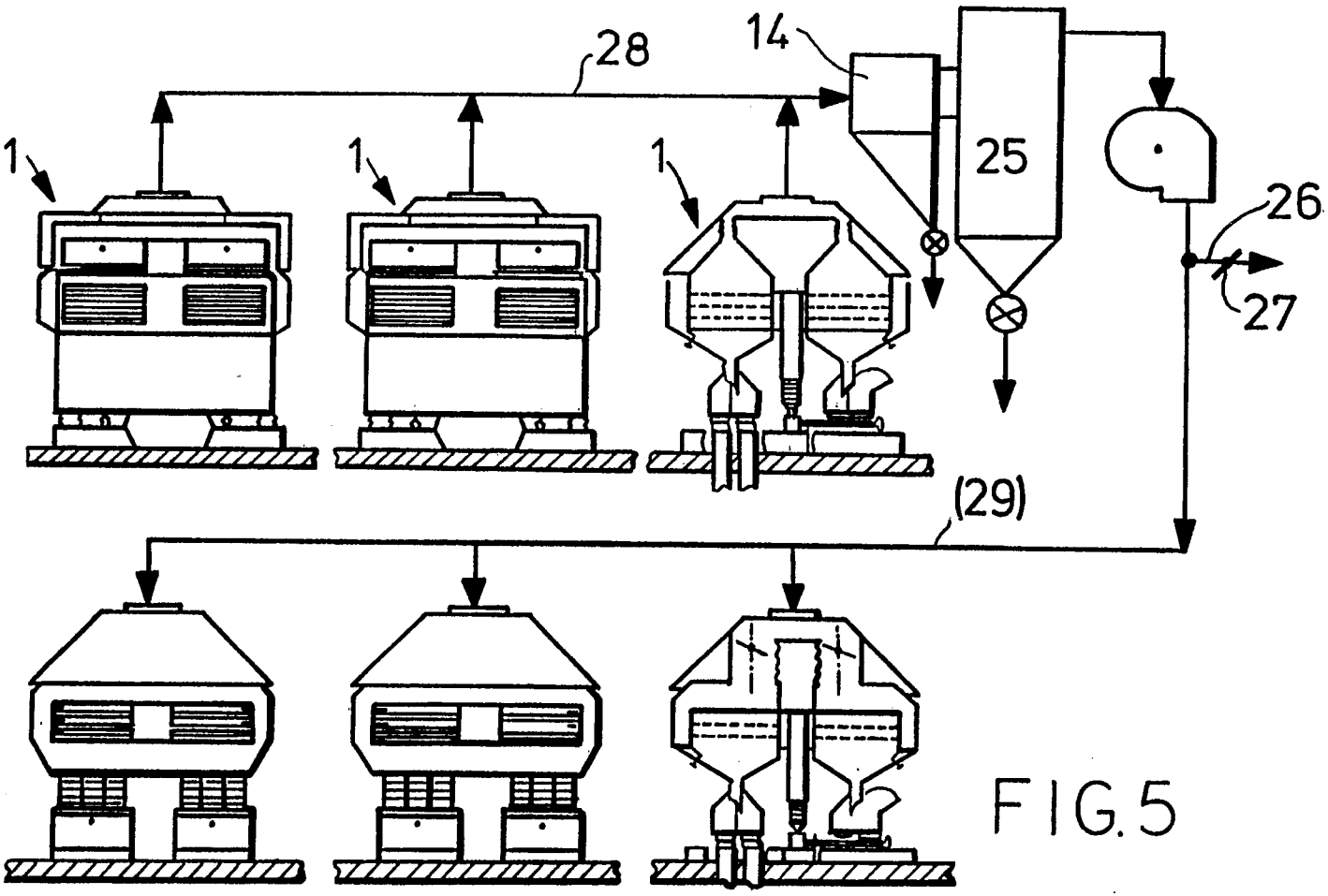
FIG. 5 shows a group of three semolina cleaning apparatuses corresponding to FIG. 4.

Analogously, FIG. 5 shows three semolina cleaning apparatuses, each constructed as a double apparatus. The air discharge is shown in the top half of the drawing, the air feed is shown in the bottom half of the drawing, each relating to the same apparatus. In contrast to FIG. 3, FIG. 5 shows a dust filter 25 and an exhaust air 26 with a controllable choke valve 27 for regulating the air pressure ratio in the system.

As indicated in FIG. 6, the inventive solution also allows a traditional operation with respect to the air exhaust. The air intake however can be effected from the upper space as shown by arrows 30, 31, 32, i.e. no longer from below from the region in the vicinity of the floor which is normally more charged with duct or bacteria. For this purpose, an air intake grate is arranged at an appropriate location.

While the foregoing description and drawings represent the preferred embodiments of the present invention, it will be obvious to those skilled in the art that various changes and modifications may be made therein without departing from the true spirit and scope of the present invention.

What is claimed is:

1. In a process for guiding air for cleaning semolina, wherein the product is cleaned via a plurality of vibrationably supported sieve layers forming a cleaning section and via product discharges for the sieve tailings and is divided into desired fractions below the sieve layers with a plurality of adjustable outlet sleeves for guiding the sieve siftings into two or more collecting troughs, the improvement comprising the steps of:

collecting exhaust air from at least two cleaning sections in an air discharge line;

sucking off the collected exhaust air via a separately arranged aspirator;

cleaning said sucked-off air and guiding said cleaned air back as feed air via a feed duct below the sieve layers;

and forming said product cleaning and air feeding elements in outwardly closed passages.

2. In a semolina cleaning apparatus having a plurality of vibrationably supported sieve layers, a source of vibration, an air feed and air discharge, a product feed and a product discharge for sieve tailings, the improvement comprising:

a product collecting base being arranged under the sieve layers, said collecting base having a plurality of adjustable outlet sleeves;

two or more collecting troughs arranged under the collecting base, said adjustable outlet sleeves coupled to said collecting troughs for conveying the sieve siftings to said collecting troughs; and said product collecting base, said air feed and said sieve layers forming a vibrating unit, and having an outwardly closed sifting space.

3. Semolina cleaning apparatus according to claim 2, wherein an air inlet for said air feed duct is arranged in an upper region at one end side of the semolina cleaning apparatus.

4. Semolina cleaning apparatus according to claim 2, wherein said air feed duct is arranged approximately at the same height as said sieve layers.

5. Semolina cleaning apparatus according to claim 2, wherein a plurality of air quantity adjustment flaps are arranged between the air feed duct and the siftings space.

6. Semolina cleaning apparatus according to claim 2, wherein the air discharge is arranged approximately in the central region above the sieve layers.

7. Semolina cleaning apparatus according to claim 2, wherein the air discharge is reconnected with the air feed duct via a separator and a ventilator for circulating air operation.

8. Semolina cleaning apparatus according to claim 2, wherein a plurality of semolina cleaning apparatuses are connected to a common air discharge line.

9. Semolina cleaning apparatus according to claim 8, wherein a plurality of semolina cleaning apparatuses in circulating air operation are connected to a common air return line.

10. Semolina cleaning apparatus according to claim 7, wherein a plurality of semolina cleaning apparatuses are connected to a common dust removing unit and can be operated with circulating air.

11. Semolina cleaning apparatus according to claim 10, wherein the circulating air is supplied by a circulating air system which has a controllable exhaust air line.

12. Semolina cleaning apparatus according to claim 2 wherein the adjustable outlet sleeves are connected to the product collecting base and have chokes.

13. Semolina cleaning apparatus according to claim 12 wherein said collecting troughs are constructed as vibrating troughs and said chokes are variable in cross section.

14. Semolina cleaning apparatus according to claim 2 wherein the sieve layers together with the collecting base and the collecting troughs have an independent vibrational drive in each instance.

15. Semolina cleaning apparatus according to claim 2, wherein the collecting troughs are constructed as closed ducts and have removal flaps for product samples on the top in the longitudinal direction.

* * * * *